United States Patent [19]

Shimai

[11] 4,206,544

[45] Jun. 10, 1980

[54] APPARATUS FOR REMOVING COUPLING ELEMENT RESIDUALS

[75] Inventor: Hideo Shimai, Namerikawa, Japan

[73] Assignee: Yoshida Kogyo K. K., Tokyo, Japan

[21] Appl. No.: 969,748

[22] Filed: Dec. 14, 1978

[30] Foreign Application Priority Data

Dec. 24, 1977 [JP] Japan ..... 52/174514[U]

[51] Int. Cl.[2] ..... B29D 5/00

[52] U.S. Cl. ..... 29/770; 83/306; 83/921

[58] Field of Search ..... 29/33.2, 408, 766, 770, 29/819; 83/306, 307, 356, 921

[56] References Cited

U.S. PATENT DOCUMENTS

| | | | |
|---|---|---|---|
| 2,645,001 | 7/1953 | Rodder | 83/306 X |
| 2,693,630 | 11/1954 | Rodder | 83/306 X |
| 3,129,498 | 4/1964 | Runnels | 29/408 X |
| 3,812,754 | 5/1974 | Kawakami | 29/408 X |
| 4,022,092 | 5/1977 | Scheib et al. | 83/306 |
| 4,024,780 | 5/1977 | Patejak | 83/306 |
| 4,139,938 | 2/1979 | Moertel | 29/766 |

FOREIGN PATENT DOCUMENTS

| | | |
|---|---|---|
| 47-20101 | 6/1972 | Japan . |
| 50-57602 | 5/1975 | Japan . |

*Primary Examiner*—Ervin M. Combs

*Attorney, Agent, or Firm*—Hill, Van Santen, Steadman, Chiara & Simpson

[57] ABSTRACT

An apparatus for removing coupling element residuals from a coupled pair of slide fastener stringers comprises a scraper roll drivable for continued rotation and an idler tumbler roll around which the slide fastener stringers travel for rotating the tumbler roll. The tumbler roll has a radial wing which when the tumbler roll is rotated, brings the coupling element residuals thereon into contact with the scraper roll while it is revolving so as to scrape off the residuals reliably. The tumbler roll has pawl means for engaging the fastener stringers at a predetermined position thereon so as to place the coupling element residuals on the tumbler wing. The tumbler roll is rotatable in response to engagement of the pawl means with the fastener stringers being fed. The apparatus of one embodiment includes stop means for temporarily stopping rotation of the tumbler roll and guide means for guiding the fastener stringers properly onto the tumbler wing.

10 Claims, 10 Drawing Figures

APPARATUS FOR REMOVING COUPLING ELEMENT RESIDUALS

BACKGROUND OF THE INVENTION

1. Field of the Invention

The present invention relates to an apparatus for removing coupling element residuals in a chain of interengaged coupling elements of pair of coupled slide fastener stringers.

2. Prior Art

One known practice of gapping or providing element-free gaps in a chain of interengaged coupling elements of a pair of coupled slide fastener stringers is composed of two distinct and independent steps; first the step of cutting off a group of intermeshing coupling heads, leaving coupling element residuals on stringer tapes, and then the step of removing the coupling element residuals from the stringer tapes. A remover of coupling element residuals is disclosed in Japanese Patent Publication No. 47-20101, the remover comprising saw-toothed scraper disks drivable for continued rotation and a pair of spaced guides for guiding a coupled pair of slide fastener stringers as they are fed below the scraper disks, the guides being spring-biased to bring the chain of coupling elements therebetween into contact with the scraper disks while they are revolving. The remover also includes means for normally urging the coupling element chain away from the scraper disks, the means being retractable, upon detecting an opening in the chain where the chain is devoid of coupling heads, so as to allow coupling element residuals in the chain to get into contact with the scraper disks, whereupon the coupling element residuals are scraped off the fastener tapes. Since the stringer tapes, when the coupling element residuals thereon engage the scraper disk, are resiliently supported only between the guides, the reactive force with which the coupling element residuals are held against the scraper disks is relatively small, and thus the scraper disks cannot firmly engage the coupling element residuals, with the result that some element debris may remain unremoved on the stringer tapes.

SUMMARY OF THE INVENTION

According to the present invention, a tumbler roll is idly rotatable on a frame for carrying a pair of coupled slide fastener stringers on its peripheral portion confronting a scraper roll including a pair of saw-toothed disks drivable for continued rotation, the tumbler roll including at least one wing projecting radially outwardly thereof for bringing by rotation of the tumbler roll the chain of coupling elements into contact with the sawteeth of the disks. The tumbler roll has means for engaging the slide fastener stringers at a predetermined position thereon so as to place coupling element residuals in the chain on the wing, the tumbler roll being rotatable engagement of the engaging means with the slide fastener stringers when they are fed along. The engaging means comprises a pawl pivotally mounted in a cavity in the wing of the tumbler roll and having a locking prong spring-biased out of the cavity. When an opening in the chain at the coupling element residuals arrives at the wing, the prong projects into the opening and engages the slide fastener stringers, whereupon the tumbler roll starts being rotated in response to advancing movement of the slide fastener stringers.

It is an object of the present invention to provide an apparatus for reliably removing coupling element residuals from a pair of coupled slide fastener stringers no matter how strongly the coupling element residuals remain attached to the stringer tapes.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION OF THE PREFERRED EMBODIMENTS

Figure 2A:
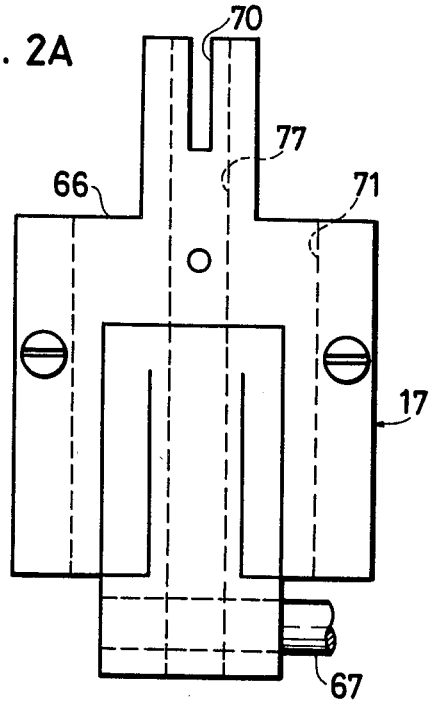
FIG. 2A, appearing with FIG. 1, is an enlarged front view of a guide for a pair of slide fastener stringers.
Figure 2:
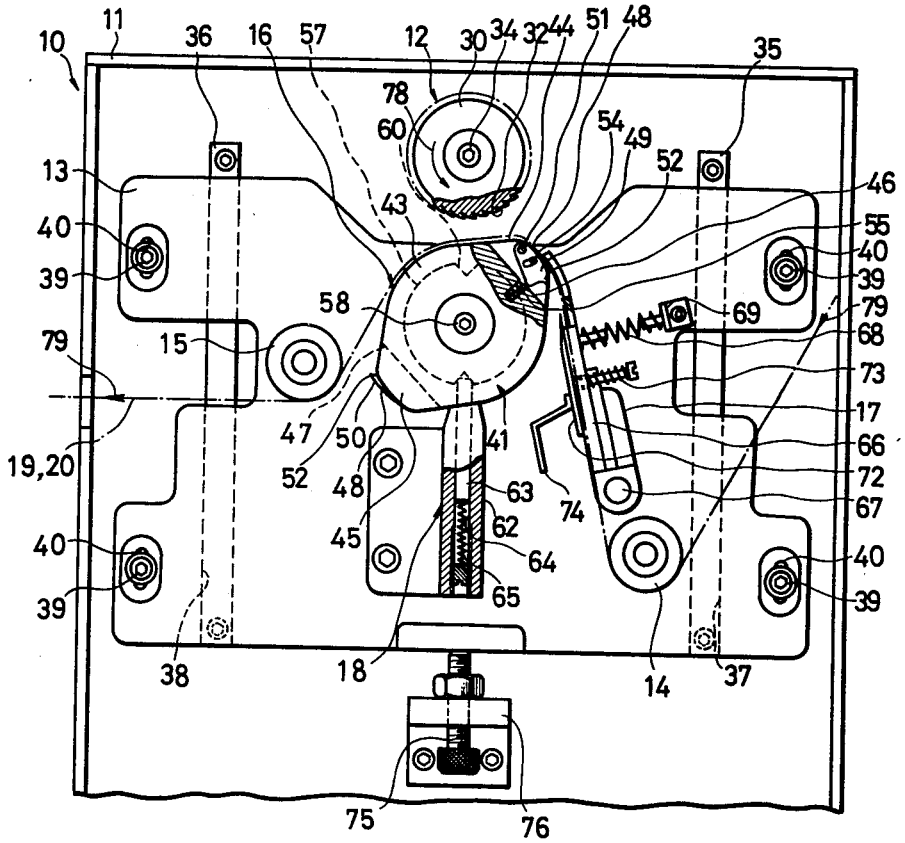
FIG. 2 is a front elevational view of an apparatus, constructed in accordance with the present invention, for removing the coupling element residuals of FIG. 1.

The principles of the present invention are particularly useful when embodied in an apparatus such as shown in FIG. 2, generally indicated in its entirety by the numeral 10. The apparatus 10 basically comprises a frame 11, a scraper roll 12 rotatably mounted on the frame 11 and drivable for continued rotation by a suitable motor (not shown), a base plate 13 vertically adjustably mounted on the frame 11, a pair of idler guide rolls 14, 15 rotatably mounted on the base plate 13, and a tumbler roll 16 idly rotatably mounted on the base plate 13. A guide 17 is pivotally mounted on the base plate 13, and a tumbler stop 18 is fixed to the base plate 13.

Figure 1:
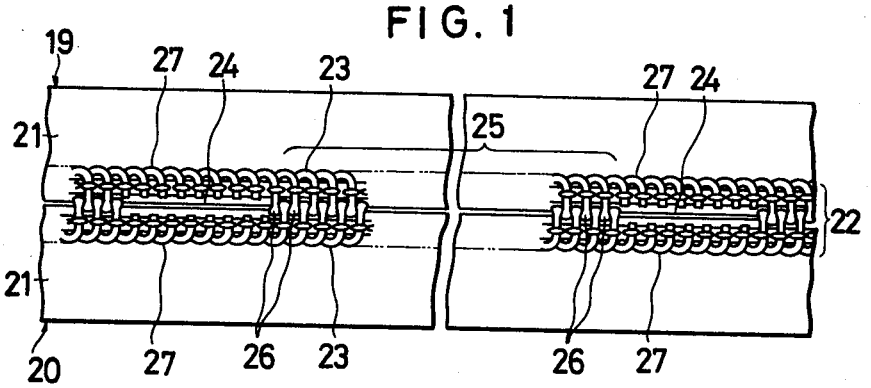
FIG. 1 is a fragmentary plan view of a pair of coupled slide fastener stringers having helically coiled coupling elements including coupling element residuals to be removed.

As shown in FIG. 1, a coupled pair of slide fastener stringers 19, 20 of continuous or substantially endless length to be processed by the apparatus 10 includes a pair of opposed stringer tapes 21, 21 and a chain 22 of a pairs of interengaged coupling elements 23, 23 of the helically coiled type mounted respectively on the stringer tapes 21, 21 by having been sewed by sewing stitches extending along opposed longitudinal tape edges. The coupling element chain 22 has a plurality of elongate openings or slots 24 located at spaced intervals therealong, there being a plurality of chain lengths 25 each disposed between two of the adjacent openings 24 and corresponding to an individual slide fastener length. The interengaged coupling elements 23, 23 include intermeshing coupling heads 26 in each chain length 25, but each opening 24 is devoid of any coupling heads and is laterally bounded by coupling element residuals 27 such as coupling element leg portions and turned-over portions.

Figure 6:
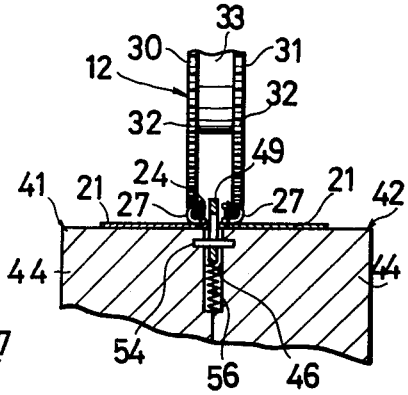
FIG. 6 is a fragmentary cross-sectional view taken along line VI—IV of FIG. 5.

As best illustrated in FIG. 6, the scraper roll 12 comprises a pair of coaxial saw-toothed disks 30, 31 spaced axially from each other and each having a peripheral series of sawteeth or serrations 32. The disks 30, 31 are spaced by a spacer 33 disposed therebetween and are fixed to a drive axle 34 (FIG. 2) for corotation.

A pair of vertical rails 35, 36 (FIG. 2) are mounted on the frame 11 and extend parallel to each other. The base plate 13 has a pair of parallel vertical slots 37, 38 in which the rails 35, 36 are slidably fitted, respectively, for guided vertical movement of the base plate 13 on the frame 11. The base plate 13 is fixed to the frame 11 by a plurality of bolts 39 extending respectively threadly into the frame 11 through a plurality of vertically elongate holes 40 in the base plate 13. The base plate 13 thus can be fixed to the frame 11 at selected positions thereon within vertical limits determined by the length of the holes 40.

Figure 3:
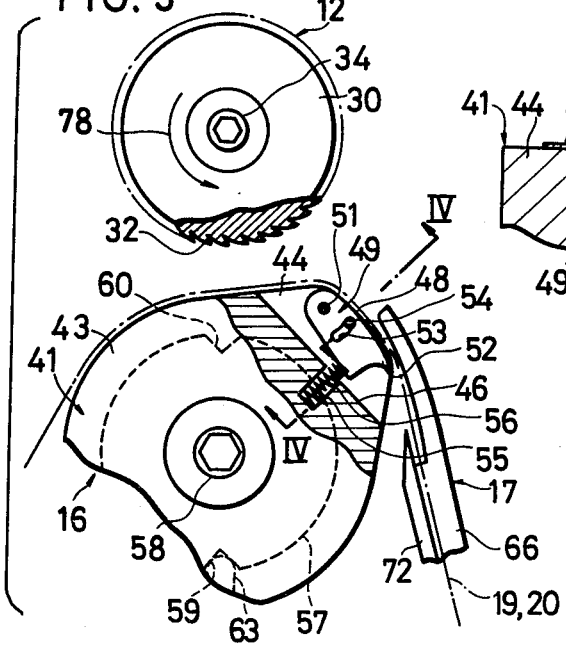
FIG. 3 is an enlarged fragmentary view, with parts in cross-section, of a tumbler roll and a scraper roll, the tumbler roll being temporarily locked against rotation.
Figure 4:
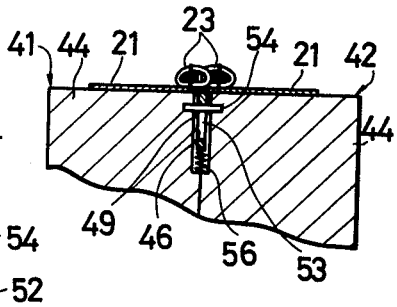
FIG. 4 is a fragmentary cross-sectional view taken along line IV—IV of FIG. 3.

As shown in FIGS. 2 through 4, the tumbler roll 16 includes a pair of substantially oval members 41, 42 (FIG. 4) each including a central circular portion 43 and a pair of diametrically opposite wings 44, 45 extending radially outwardly from the central circular portion 43. The wings 44, 45 have a pair of cavities 46, 47, respectively, that open radially outwardly and are disposed between the oval tumbler members 41, 42. Each of the wings 44, 45 has an arcuate peripheral surface 48 on which the pair of slide fastener stringers 19, 20 are supportable. A pair of pawls 49, 50 are pivotally mounted in the cavities 46, 47, respectively. Each pawl 49, 50 is connected at one end to a pin 51 extending across one of the cavities 46, 47 into the tumbler members 41, 42, and has a locking prong 52 at the other end. Each of the pawls 49, 50 has an arcuate slot 53 that is situated substantially centrally between the ends of the pawl and through which loosely extends a pin 54 spanning across one of the cavities 46, 47 between the tumbler members 41, 42. The tumbler members 41, 42 jointly have a pair of recesses 55 (one shown in FIG. 3) opening to the cavities 46, 47 and each receives therein a spring 56 acting between the bottom of the recess 55 and one of the pawls 49, 50 and normally urging the locking prong 52 out of the corresponding one of the cavities 46, 47.

A circular plate 57 is coaxially secured to the tumbler roll 16, which is idly rotatable on a shaft 58 extending from the base plate 13. The arcuate surface 48 on each tumbler wing 44, 45 comprises a portion of an imaginary cylinder extending about the shaft 58. The circular plate 57 has a pair of diametrically opposite notches 59, 60 in its circumference which are angularly spaced from the wings 44, 45.

As best shown in FIG. 2, the tumbler stop 18 includes a support 62 bolted to the base plate 13, and a locking rod 63 slidably disposed in a vertical bore 64 in the support 62, there being a spring 65 acting on the rod 63 for normally biasing the rod 63 toward the circular plate 57 to place its distal end into one of the notches 59, 60 upon alignment of such distal rod end with said one notch. The force with which the rod 63 is biased toward the circular plate 57 is such that the distal rod end disposed in one of the notches 59, 60 holds the tumbler roll 16 nonrotatable, but is forcibly movable out of said one notch when the tumbler roll 16 is caused to rotate around the shaft 58.

The guide 17 shown in FIGS. 2 and 2A comprises a body 66 pivotally mounted on the base plate 13 by means of a pin 67 and in normally urged toward the tumbler roll 16 by a spring 68 acting between the body 66 and a spring seat 69 fixed to the base plate 13. The guide body 66 has a slot 70 at a position remote from the pin 67 and a channel 71 for receiving the slide fastener stringers 19, 20 therein so as to guide the stringers 19, 20 therealong. The guide body 66 also has a groove 77 in the channel 71, the slide fastener chain 22 being movable in and along the groove 77. The slot 70 is located centrally of the groove 77 and acts as a clearance for the locking prongs 52 of the pawls 49, 50. A support plate 72 covers the channel 71 and is pressed against the guide body 66 under the force of a spring 73 so as to retain the slide fastener stringers 19, 20 in the channel 71. By pulling a handle lever 74 fixed to the support plate 72, the support plate 72 can be moved away from the guide body 66 for facilitating the insertion of the slide fastener stringers 19, 20 into the channel 71.

An adjustment screw 75 threadedly extending through a flange 76 mounted on the frame 11 allows fine positional adjustment of the base plate 13.

The apparatus 10 operates as follows: The base plate 13 is positionally adjusted by the adjusting screw 75 so that the tumbler roll 16 is spaced a suitable distance from the scraper roll 12. The coupled pair of slide fastener stringers 19, 20 is placed around the guide roll 14, through the channel 71 in the guide 17, around the tumbler roll 16, and thence around the guide roll 15. The scraper roll 12 is continuously driven to rotate counterclockwise in the direction of the arrow 78 (FIG. 2), and the slide fastener stringers 19, 20 are fed along in the direction of the arrowheads 79. In FIGS. 3 and 4, the tumbler roll 16 is held against rotation by the distal end of the rod 63 received in one of the notches 59 as long as the pawl 49 is pressed downwardly under one of the chain lengths 25, with the locking prong 52 retained in the cavity 46. At this time, the slide fastener stringers 19, 20 slide in their advancing movement over the arcuate surface 48 of one of the tumbler wings 44 which is temporarily held immovable at a position away from the scraper roll 12. The slide fastener stringers 19, 20 while being progressed are pressed down against the arcuate surface 48 of the tumbler wing 44 by the slotted portion of the guide body 66, and are guided in the channel 71 and the groove 77 so that the slide fastener chain 22 moves along in alignment with the cavity 46.

Figure 5:
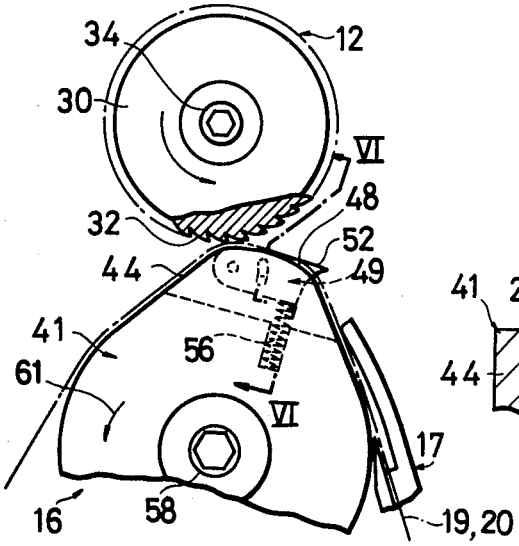
FIG. 5 is a view similar to FIG. 3, showing the position of the working parts in which coupling element debris is just about to be scraped off.

When one of the openings 24 in the chain 22 arrives at the tumbler wing 44 and moves onto the arcuate surface 48, the locking prong 52 projects out of the cavity 46 upwardly into the opening 24 under the force from the spring 56. Further advancing movement of the slide fastener stringers 19, 20 causes an end of one of the chain lengths 25 that follows the opening 24 in which the locking prong 52 has entered, to engage the locking prong 52 and force the pawl 49 to move with the stringers 19, 20. At this time, the coupling element residuals 27 along the opening 24 are placed on the arcuate surface 48 of the wing 44. The locking rod 63 of the tumbler stop 18 is then forcibly displaced downwardly by the force with which the pawl 49 is pushed forwardly by the advance of the slide fastener stringers 19, 20, until the distal rod end is displaced from the notch 59. The tumbler roll 16 starts rotating counterclockwise in the direction of the arrow 61 (FIG. 5), whereupon the tumbler wing 44 angularly moves to a position below the scraper roll 12. The coupling element residuals 27 on the arcuate surface 48 of the wing 44 are brought into contact with the sawteeth 32 of the disks 30, 31 while they are revolving, as best shown in FIG. 6. The coupling element residuals 27 are scraped away by contact with the sawteeth 32. The coupling element residuals 27 are reliably removed since they are held against the arcuate surface 48 of the tumbler wings 44, 45. The spacer 33 between the saw-toothed disks 30, 31 has a selected thickness such that the sawteeth 32 on the disks 30, 31 do not impair the sewed stitches by which the coupling elements 23, 23 are attached to the stringer tapes 21, 21. It is preferably to rotate the scraper roll 12 in a direction that is opposite to the direction of travel of the slide fastener stringers 19, 20 where they are engaged by the scraper roll 12, whereby the sawteeth 32 can strike the coupling element residuals 27 at an increased relative speed for reliable removal of the residuals 27. Further, the arcuate surface 48 of each wing 44, 45 should have a length equal to that of each opening 24 in the slide fastener chain 22 that is to be processed by the apparatus 10.

As the tumbler roll 16 is further rotated, the locking prong 52 of the pawl 49 disengages the end of the chain length 25, and the distal end of the rod 63 now enters the notch 60. The tumbler roll 16 is then held against rotation, at which time the other tumbler wing 45 takes the position of FIGS. 2 and 3 for a next cycle of operation.

Figure 7:
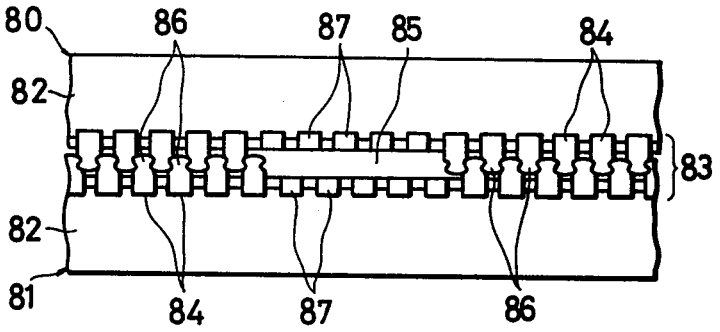
FIG. 7 is a fragmentary plan view of a pair of coupled slide fastener stringers having injection-molded, discrete coupling elements including coupling element residuals to be taken away.
Figure 9:
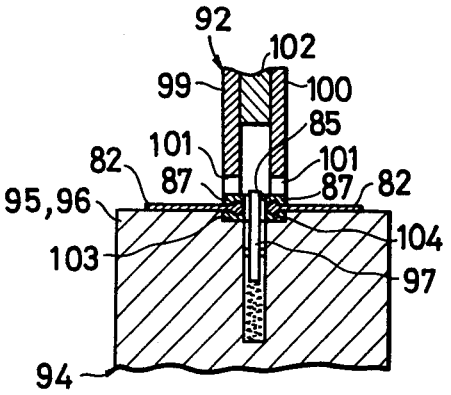
FIG. 9, appearing on sheet 4, is an enlarged cross-sectional view of a tumbler roll and a scraper roll in the apparatus of FIG. 8
Figure 8:
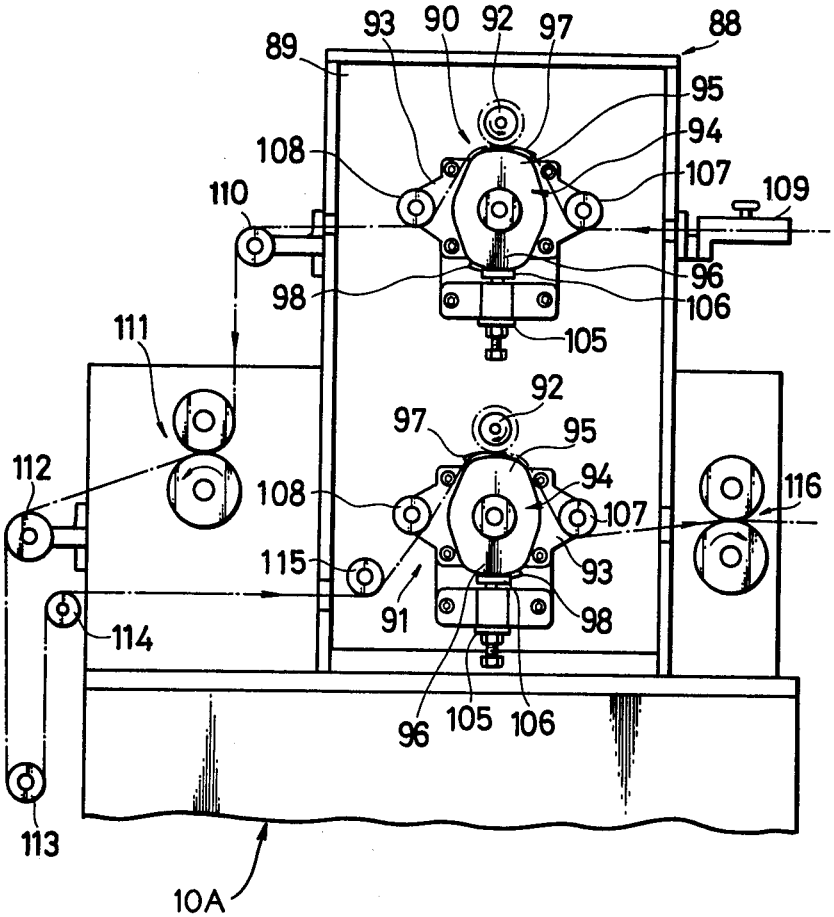
FIG. 8 is a front elevational view of a modified apparatus; according to the invention, for removing the coupling element residuals of FIG. 7.

A coupled pair of continuous slide fastener stringers 80, 81 shown in FIG. 7 comprise a pair of opposed stringer tapes 82, 82 and a chain 83 of a pair of interengaged coupling elements 84, 84 of the discrete type which are mounted as by injection-molding on and astride a pair of opposed longitudinal tape edges. A plurality of openings 85 (only one illustrated) are provided in the chain 83 by severing intermeshing coupling heads 86. Coupling element residuals 87 that are composed mainly of coupling element legs are attached to both surfaces of the stringer tapes 82, 82 as best shown in FIG. 9. The slide fastener stringers 80, 81 are processed for the removal of the coupling element residuals 87 in an apparatus generally indicated at 88 in FIG. 8. The apparatus 88 comprises a frame 89, a pair of first and second scraper assemblies 90, 91 each including a scraper roll 92 rotatable on the frame 89, a base plate 93 mounted on the frame 89, and a tumbler roll 94 rotatable on the base plate 93. Each tumbler roll 94 includes a pair of diametrically opposite wings 95, 96 in which there are pivotally mounted a pair of spring-loaded pawls 97, 98, respectively. As shown in FIG. 9, each scraper roll 92 comprises a pair of saw-toothed disks 99, 100 having peripheral sawteeth 101 and axially spaced from each other by a spacer 102 located therebetween. There are a pair of guide recesses 103, 104 in an arcuate surface of each wing 95, 96 on which the slide fastener stringers 80, 81 are supportable, portions of the coupling element residuals 87 that are on one of the tape surfaces being receivable in the guide recesses 103, 104. As illustrated in FIG. 8, a pair of brakes 105, 105 are adjustably supported on the base plates 93, 93, respectively, each brake 105 having a brake shoe 106 engageable with the tumbler wings 95, 96. Each base plate 93 supports a pair of idler rolls 107, 108 one on each side of the tumbler roll 94.

The slide fastener stringers 80, 81 are guided through an inlet guide 109 into the first scraper assembly 90 where they extend around the idler roll 107, the tumbler roll 94, and the idler roll 108. The stringers 80, 81 then travel around a guide roller 110, are transported by a first feed roller unit 111, and are fed to the second scraper assembly 91 via a guide roller 112, a tensioning roller 113, a guide roller 114, and a guide roller 115. The stringers 80, 81 are fed around the idler roll 108, the tumbler roll 94, and the idler roll 107, and are discharged out of the apparatus 10A by means of a second feed roller unit 116. With such an arrangement, the coupling element residuals 87 on one of the stringer tape surfaces are scraped off by the first scraper assembly 90, and those on the other stringer tape surface are removed by the second scraper assembly 91. Although the tumbler rolls 94, 94 tend to be rotated at fluctuating speeds because of inermittent engagement of the scraper rolls 92, 92 with the coupling element residuals 87 that are discrete, such a tendency is eliminated by the brake shoes 106, 106 frictionally engaging the tumbler wings 95, 96. Accordingly, the tumbler rolls 94, 94 rotate smoothly at a constant speed.

Although various minor modifications might be suggested by those versed in the art, it should be understood that I wish to embody within the scope of the patent warranted hereon, all such embodiments as reasonably and properly come within the scope of my contribution to the art.

I claim:

1. An apparatus for removing coupling element residuals from a chain of interengaged coupling elements of a coupled pair of slide fastener stringers moving along a path therein, comprising:

(a) a frame;

(b) a scraper roll rotatably mounted on said frame and having peripheral tooth means, said scraper roll being adapted to be driven for continued rotation;

(c) a tumbler roll idly rotatably supported on said frame for carrying the slide fastener stringers on its peripheral portion confronting said tooth means, said tumbler roll including a wing projecting radially outwardly thereof for bringing the chain of coupling elements thereon into contact with said tooth means by rotation of said tumbler roll; and (d) means on said tumbler roll for initially engaging the slide fastener stringers at a predetermined position thereon so as to place the coupling element residuals on said wing, said tumbler roll being thereafter rotatable in response to engagement of said engaging means with the slide fastener stringers while the latter are being fed along said path.

2. An apparatus according to claim 1, including a base plate positionally adjustably mounted on said frame, said tumbler roll being mounted for idling rotation on said base plate, and said tumbler roll being movable toward and away from said scraper roll on adjustment of said base plate.

3. An apparatus according to claim 1, said wing having an arcuate surface on which the slide fastener stringers are supportable, said arcuate surface comprising a portion of an imaginary cylinder extending about the rotational axis of said tumbler roll.

4. An apparatus according to claim 1 for use with a chain having an opening at each of a plurality of spaced groups of the residuals, each pair of successive openings defining a chain length therebetween, said engaging means comprising:

(a) a pawl pivotally mounted in a cavity in said wing and having a prong for projecting into one of the openings in the chain and for engaging a end of one of the chain lengths which is adjacent to said one of the openings, and (b) a spring acting between said pawl and said tumbler roll and normally urging said prong out of said cavity.

5. An apparatus according to claim 4, said scraper roll comprising a pair of coaxial saw-toothed disks spaced from each other, said wing of the tumbler roll being positionable in confronting relation to said scraper roll with said cavity located between said pair of saw-toothed disks.

6. An apparatus according to claim 1, including stop means on said frame for temporarily locking said tumbler roll against rotation until said engaging means is engaged by the slide fastener stringers to rotate said tumbler roll.

7. An apparatus according to claim 6, said tumbler roll including a coaxial circular plate having a notch in its periphery, said stop means comprising a rod movable to place its one end into and out of said notch, and a spring acting on said rod and normally biasing said rod end toward said circular plate.

8. An apparatus according to claim 6, including guide means supported on said frame for pressing the slide fastener stringers against said wing when said tumbler roll is temporarily stopped by said stop means.

9. An apparatus according to claim 8, said guide means comprising a body pivotally supported on said frame and having a groove, and a spring acting on said body for normally urging said body against the slide fastener stringers with the chain disposed in said groove.

10. An apparatus for removing a plurality of spaced groups of coupling element residuals from a chain of interengaged coupling elements of a coupled pair of slide fastener stringers moving along a path therein, comprising:

(a) a frame;

(b) a scraper roll rotatably mounted on said frame and having peripheral tooth means, said scraper roll being adapted to be driven for continued rotation;

(c) a tumbler roll idly rotatably supported on said frame for carrying the slide fastener stringers on its peripheral portion confronting said tooth means, said tumbler roll including a pair of wings projecting radially outwardly thereof in diametrically opposed relation for bringing the chain of coupling elements on one of the wings into contact with said tooth means when said tumbler is rotated; and (d) means on said tumbler roll for initially engaging the slide fastener stringers at a predetermined position thereon so as (1) to place one of the groups of coupling element residuals at a time onto said one of the wings, and (2) to thereafter rotate said tumbler roll in response to the engagement of said engaging means with the slide fastener stringers when the latter are fed along said path.

* * * * *